US011111907B1

(12) United States Patent
Sahm

(10) Patent No.: US 11,111,907 B1
(45) **Date of Patent: *Sep. 7, 2021**

(54) FLUID TRANSFER AND DEPRESSURIZATION SYSTEM

(71) Applicant: TPE MIDSTREAM LLC, Lutz, FL (US)

(72) Inventor: Douglas A Sahm, Lutz, FL (US)

(73) Assignee: TPE MIDSTREAM LLC, Lutz, FL (US)

( * ) Notice: Subject to any disclaimer, the term of this patent is extended or adjusted under 35 U.S.C. 154(b) by 11 days.

This patent is subject to a terminal disclaimer.

(21) Appl. No.: 16/549,729

(22) Filed: Aug. 23, 2019

Related U.S. Application Data

(63) Continuation of application No. 16/129,225, filed on Sep. 12, 2018, now Pat. No. 10,443,586.
(Continued)

(51) Int. Cl.
*F04B 9/133* (2006.01)
*F04B 39/12* (2006.01)
(Continued)

(52) U.S. Cl.
CPC ..... *F04B 9/133* (2013.01); *F04B 1/02* (2013.01); *F04B 7/0266* (2013.01);
(Continued)

(58) Field of Classification Search
CPC .... F17D 3/10; F17D 5/02; F04B 9/133; F04B 9/12; F04B 1/02; F04B 7/0266;
(Continued)

(56) References Cited

U.S. PATENT DOCUMENTS 919,909 A 4/1909 Meech
1,782,975 A 11/1930 Schaer
(Continued)

FOREIGN PATENT DOCUMENTS

EP 2264288 12/2010
GB 1503648 A * 3/1978 ..... F04B 9/133
WO 2017093396 6/2017

OTHER PUBLICATIONS

United States Patent and Trademark Office, "Non-Final Office Action", issued in connection with U.S. Appl. No. 16/129,225 dated Mar. 7, 2019, 7 pages.
(Continued)

*Primary Examiner* — Nathan C Zollinger
(74) *Attorney, Agent, or Firm* — Hanley, Flight & Zimmerman, LLC

(57) ABSTRACT

A gas transfer and depressurization system that is configured to transfer gas from a first location to a second location wherein during the transfer of gas the pressure of the first location is reduced. The gas transfer and depressurization system includes a drive chamber having an interior volume with a drive assembly movably disposed therein. A first cylinder and a second cylinder are operably coupled to the drive chamber on opposing sides thereof. The drive assembly includes a drive rod having portions extending into the first cylinder and second cylinder wherein the drive rod has pistons formed on opposing ends thereof. A controller is operably coupled to a compressed air source and is configured to provide compressed air into said drive chamber so as to reciprocally move the drive assembly. Gas blocks and coupling block are additionally present and facilitate flow of gas intermediate the first and second cylinders.

20 Claims, 7 Drawing Sheets

Related U.S. Application Data

(60) Provisional application No. 62/670,810, filed on May 13, 2018.

(51) Int. Cl.

| | |
|---|---|
| ***F04B 7/02*** | (2006.01) |
| ***F04B 1/02*** | (2006.01) |
| ***F04B 53/16*** | (2006.01) |
| ***F04B 17/03*** | (2006.01) |
| ***F04B 25/00*** | (2006.01) |
| *F17D 3/10* | (2006.01) |
| *F17D 5/02* | (2006.01) |

(52) U.S. Cl.
CPC ..... *F04B 39/122* (2013.01); *F04B 39/123* (2013.01); *F04B 53/16* (2013.01); *F04B 17/03* (2013.01); *F04B 25/00* (2013.01); *F17D 3/10* (2013.01); *F17D 5/02* (2013.01)

(58) Field of Classification Search
CPC ..... F04B 17/03; F04B 25/00; F04B 25/005; F04B 27/02; F04B 53/08; F04B 53/16; F04B 39/12; F04B 39/121; F04B 39/123; F04B 39/122
See application file for complete search history.

(56) References Cited

U.S. PATENT DOCUMENTS 1,870,848 A 8/1932 Hewitt
2,072,314 A 3/1937 Rhodes
2,887,293 A 5/1959 Gasche
3,272,894 A 9/1966 Roach
3,282,167 A 11/1966 Mckenzie
3,489,100 A 1/1970 Hill
3,540,349 A 11/1970 Pennther
3,591,240 A 7/1971 Seymour
3,612,479 A 10/1971 Smith, Jr.
3,626,576 A 12/1971 Ray
3,665,966 A 5/1972 Ver Nooy
3,746,027 A 7/1973 Elliott
3,746,047 A 7/1973 Peters
3,867,964 A 2/1975 Gardner
3,905,729 A 9/1975 Bauer
3,963,383 A 6/1976 Hill
4,026,329 A 5/1977 Thompson
4,144,908 A 3/1979 Dunn
4,350,266 A 9/1982 Hetherington et al.
4,351,349 A 9/1982 Minotti
4,377,945 A 3/1983 Di Giovanni et al.
4,382,750 A 5/1983 Robertson et al.
4,390,322 A 6/1983 Budzich
4,405,292 A 9/1983 Bixby, Jr. et al.
4,413,655 A 11/1983 Brown
4,441,862 A 4/1984 Vogel
4,457,326 A 7/1984 Donnelly
4,478,556 A 10/1984 Gozzi
4,497,332 A 2/1985 Sewell et al.
4,653,986 A 3/1987 Ashton
4,677,827 A 7/1987 Shenoy et al.
4,730,991 A * 3/1988 Handfield ..... F04B 9/133 417/397
4,761,118 A * 8/1988 Zanarini ..... F04B 9/115 417/254
5,062,207 A 11/1991 Martin et al.
5,094,596 A 3/1992 Erwin et al.
5,273,405 A * 12/1993 Chalmers ..... F01L 25/08 417/397
5,324,175 A 6/1994 Sorensen et al.
5,399,073 A 3/1995 Bauer
5,577,528 A 11/1996 Saha et al.
5,778,919 A 7/1998 Petrone
5,863,186 A * 1/1999 Green ..... F04B 9/113 417/244
5,967,191 A 10/1999 Mummolo
5,975,122 A 11/1999 Hazen et al.
6,261,070 B1 7/2001 Johnson
6,283,153 B1 9/2001 Brisco et al.
6,612,330 B1 9/2003 Robison et al.
6,652,241 B1 11/2003 Alder
6,841,007 B1 1/2005 Howard et al.
6,899,138 B2 5/2005 Lundman
7,021,328 B2 4/2006 Robison et al.
7,281,565 B2 10/2007 Carmen, Jr. et al.
7,296,587 B2 11/2007 Gill
7,311,114 B2 12/2007 Morrison et al.
7,500,834 B2 3/2009 Durward
8,001,988 B2 8/2011 Wilson et al.
8,028,535 B2 10/2011 Sikora
8,147,218 B2 4/2012 Thrasher et al.
8,186,972 B1 5/2012 Glauber
8,197,611 B2 6/2012 Strohmeier et al.
8,220,479 B1 7/2012 Mayeaux
8,299,734 B2 10/2012 Mullet et al.
8,368,328 B2 2/2013 Mullet et al.
8,548,756 B1 10/2013 Foley
8,791,658 B2 7/2014 Mullet et al.
8,947,027 B2 2/2015 Mullet et al.
9,018,868 B2 4/2015 Lucas et al.
9,073,556 B2 7/2015 Foege et al.
9,115,821 B2 8/2015 Bauer et al.
9,152,032 B2 10/2015 Mullet et al.
9,194,179 B2 11/2015 Mullet et al.
9,403,105 B2 8/2016 Felisari et al.
9,714,852 B2 7/2017 Moore et al.
9,739,271 B2 8/2017 Chang
9,777,959 B2 10/2017 Bonnissel et al.
9,816,497 B2 * 11/2017 Strickland ..... F04B 27/005
9,890,585 B2 2/2018 Mullet et al.
9,976,686 B2 5/2018 Sander et al.
10,018,303 B1 7/2018 Won et al.
10,139,259 B2 11/2018 Chen et al.
10,247,338 B2 4/2019 Bryngelson et al.
10,247,643 B1 4/2019 Johnsen
10,330,238 B2 6/2019 Theener
10,443,586 B1 * 10/2019 Sahm ..... F04B 7/0266
10,465,833 B2 11/2019 Huffman et al.
10,533,694 B1 1/2020 VanderLans et al.
2003/0172661 A1 9/2003 Yaroslavovich et al.
2007/0095400 A1 5/2007 Bergquist et al.
2007/0284011 A1 12/2007 Freyer et al.
2011/0236224 A1 9/2011 Glauber
2017/0254717 A1 9/2017 McNeil et al.
2017/0314549 A1 11/2017 Chang et al.
2017/0335840 A1 11/2017 Hausle
2018/0231184 A1 8/2018 Won et al.
2018/0356044 A1 12/2018 Monti et al.
2019/0195213 A1 6/2019 Burrows
2019/0219211 A1 7/2019 Kraige et al.
2019/0257464 A1 8/2019 Czaplewski et al.
2019/0338858 A1 11/2019 Mainzer et al.
2020/0003246 A1 1/2020 Kaveney et al.
2020/0018435 A1 1/2020 Huffman et al.

OTHER PUBLICATIONS

United States Patent and Trademark Office, "Notice of Allowance and Fee(s) Due", issued in connection with U.S. Appl. No. 16/129,225 dated Jun. 19, 2019, 12 pages.

* cited by examiner

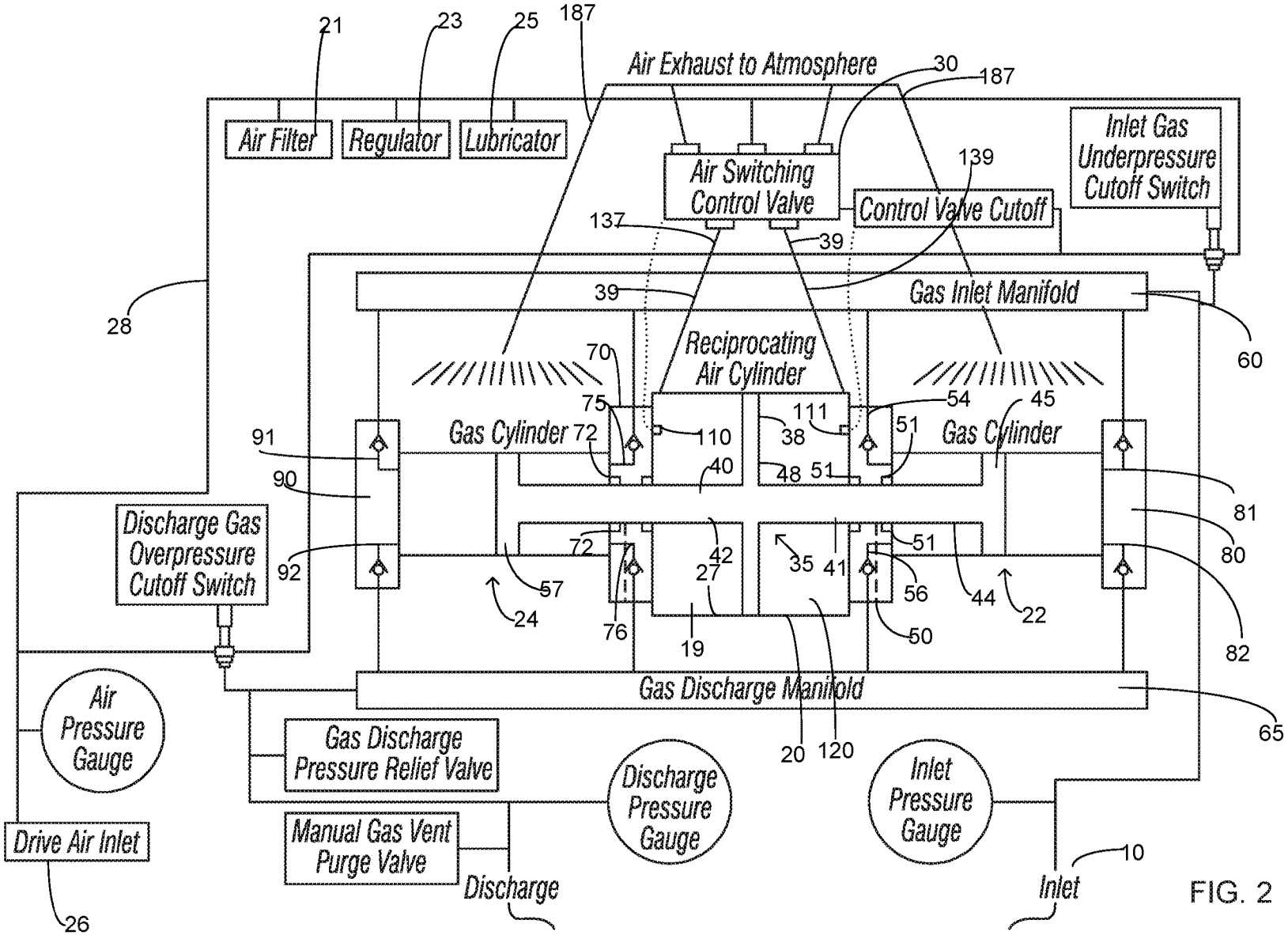
Inlet Gas Underpressure Cutoff Switch
Control Valve Cutoff
Air Switching Control Valve
Air Exhaust to Atmosphere
Gas Inlet Manifold
Gas Cylinder
Reciprocating Air Cylinder
Gas Cylinder
Gas Discharge Manifold
Inlet Pressure Gauge
Inlet
Discharge Pressure Gauge
Discharge
Gas Discharge Pressure Relief Valve
Manual Gas Vent Purge Valve
Lubricator
Regulator
Air Filter
Discharge Gas Overpressure Cutoff Switch
Air Pressure Gauge
Drive Air Inlet
FIG. 2

FLUID TRANSFER AND DEPRESSURIZATION SYSTEM

CROSS REFERENCE TO RELATED APPLICATIONS

This application is a continuation of U.S. patent application Ser. No. 16/129,225 (now U.S. Pat. No. 10,443,586), filed Sep. 12, 2018, entitled, "Fluid Transfer and Depressurization System," which claims the benefit under 35 U.S.C. § 119(e) to U.S. Provisional Application Ser. No. 62/670,810, filed May 13, 2018, entitled "Fluid Transfer and Depressurization Apparatus," both of which are hereby incorporated for reference.

FIELD OF THE INVENTION

The present invention relates generally to pipeline and vessel fluid transfer, more specifically but not by way of limitation, a pipeline and vessel fluid transfer apparatus that is configured to facilitate fluid transfer from a pipeline or vessel to another pipeline portion or vessel wherein during the fluid/gas transfer no emission of the fluid occurs into the atmosphere.

BACKGROUND

The United States has the largest network of energy pipelines in the world with approximately two and a half million miles of pipelines distributed across the continent. This network of pipelines is utilized to transport materials such as but not limited to crude oil and natural gas. The material disposed within the pipes is moved therethrough utilizing pumping stations so as to distribute to locations such as but not limited to ports and other facilities. Oil pipelines are typically manufactured from steel and/or plastic wherein natural gas pipelines are manufactured from carbon steel and are constructed to accommodate the pressurization of the natural gas or other similar gaseous fuels. Pipeline conveying flammable or explosive material such as but not limited to natural gas present various safety concerns. Routine operation of the pipeline must be carried out under strict safety protocols to prevent accidents such as but not limited to explosions or fires.

Routine pipeline or vessel maintenance is required for pipelines/vessels such as but not limited to natural gas pipelines/vessels. By way of example but not limitation, tasks such as filter replacements, equipment maintenance and pipeline pig launching/receiving require a portion of the pipeline to be emptied of its contents in order to facilitate the performance of the aforementioned activities. Presently, the two most common methods to discharge the contents of a portion of a pipeline are venting and flaring. In the former, the material such as but not limited to natural gas is vented to atmosphere. Flaring involves the release of the material to atmosphere and further igniting so as to burn the material during the release from the pipeline. Both venting and flaring bear significant safety and environmental risks. Less than whole-line depressurizations are performed daily as part of routine pipeline operation and maintenance. The aforementioned common practices of venting and flaring face significant regulatory pressure as the release of gases such as but not limited to methane have been identified as a major source of greenhouse gas. To perform the conventional operations of venting or flaring most states require permitting, which adds to the cost of operations and further requires additional time to acquire the permits.

Accordingly, there is a need for a fluid depressurization and transfer apparatus that is configured to facilitate the transfer of a fluid from a pipeline or vessel to another vessel or portion of a pipeline wherein no emission of the fluid occurs to atmosphere during the transfer process.

SUMMARY OF THE INVENTION

It is the object of the present invention to provide a fluid transfer apparatus configured to provide an emission-free transfer of a fluid from a pipeline or vessel to a suitable location wherein the apparatus utilizes a compressed air source to provide operation thereof.

Another object of the present invention is to provide a fluid transfer and depressurization apparatus configured to depressurize a vessel or a portion of a pipeline and transfer the contents disposed therein to a second location that includes a drive chamber pneumatically coupled to the air source.

A further object of the present invention is to provide a fluid transfer apparatus configured to provide an emission-free transfer of a fluid from a pipeline or vessel to a suitable location that includes a first gas cylinder operably coupled to the drive chamber.

Still another object of the present invention is to provide a fluid transfer and depressurization apparatus configured to depressurize a vessel or a portion of a pipeline and transfer the contents disposed therein to a second location that includes a second gas cylinder wherein the second gas cylinder is operably coupled to the drive chamber opposite the first gas cylinder.

An additional object of the present invention is to provide a fluid transfer apparatus configured to provide an emission-free transfer of a fluid from a pipeline or vessel to a suitable location wherein the drive chamber has disposed therein a drive assembly that further includes a drive block and rod wherein the rod is operably coupled with the first gas cylinder and second gas cylinder.

Yet a further object of the present invention is to provide a fluid transfer and depressurization apparatus configured to depressurize a vessel or a portion of a pipeline and transfer the contents disposed therein to a second location that further includes a first coupling block intermediate the first gas cylinder and the drive chamber configured to provide the operable coupling thereof.

Another object of the present invention is to provide a fluid transfer apparatus configured to provide an emission-free transfer of a fluid from a pipeline or vessel to a suitable location that further includes a second coupling block operably intermediate the drive chamber and the second gas cylinder.

Still an additional object of the present invention is to provide a fluid transfer and depressurization apparatus configured to depressurize a vessel or a portion of a pipeline and transfer the contents disposed therein to a second location that further includes a gas tubing network configured to facilitate the intake of a gas from a first source and provide discharge thereof to a second source.

An alternative object of the present invention is to provide a fluid transfer apparatus configured to provide an emission-free transfer of a fluid from a pipeline or vessel to a suitable location that further includes a pneumatic controller operable coupled to the compressed air source and configured to provide operation of the drive assembly.

An additional object of the present invention is to provide a fluid transfer and depressurization apparatus configured to depressurize a vessel or a portion of a pipeline and transfer the contents disposed therein to a second location that includes at least one gas inlet manifold configured to distribute a gas to either the first and/or the first gas cylinder and second gas cylinder.

Another object of the present invention is to provide a fluid transfer apparatus configured to provide an emission-free transfer of a fluid from a pipeline or vessel to a suitable location that further includes at least one gas discharge manifold operably coupled to either the first gas cylinder and/or the second gas cylinder wherein the at least one gas discharge manifold is configured to initiate the distribution of the gas being transferred to the second location.

Yet a further object of the present invention is to provide a fluid transfer and depressurization apparatus configured to depressurize a vessel or a portion of a pipeline and transfer the contents disposed therein to a second location wherein the gas tubing network further includes elements such as but not limited to purge valves, pressure gauges, cutoff switches and regulators.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

FIG. 2 is a diagrammatic view of an embodiment of the present invention.

DETAILED DESCRIPTION

Figure 1:
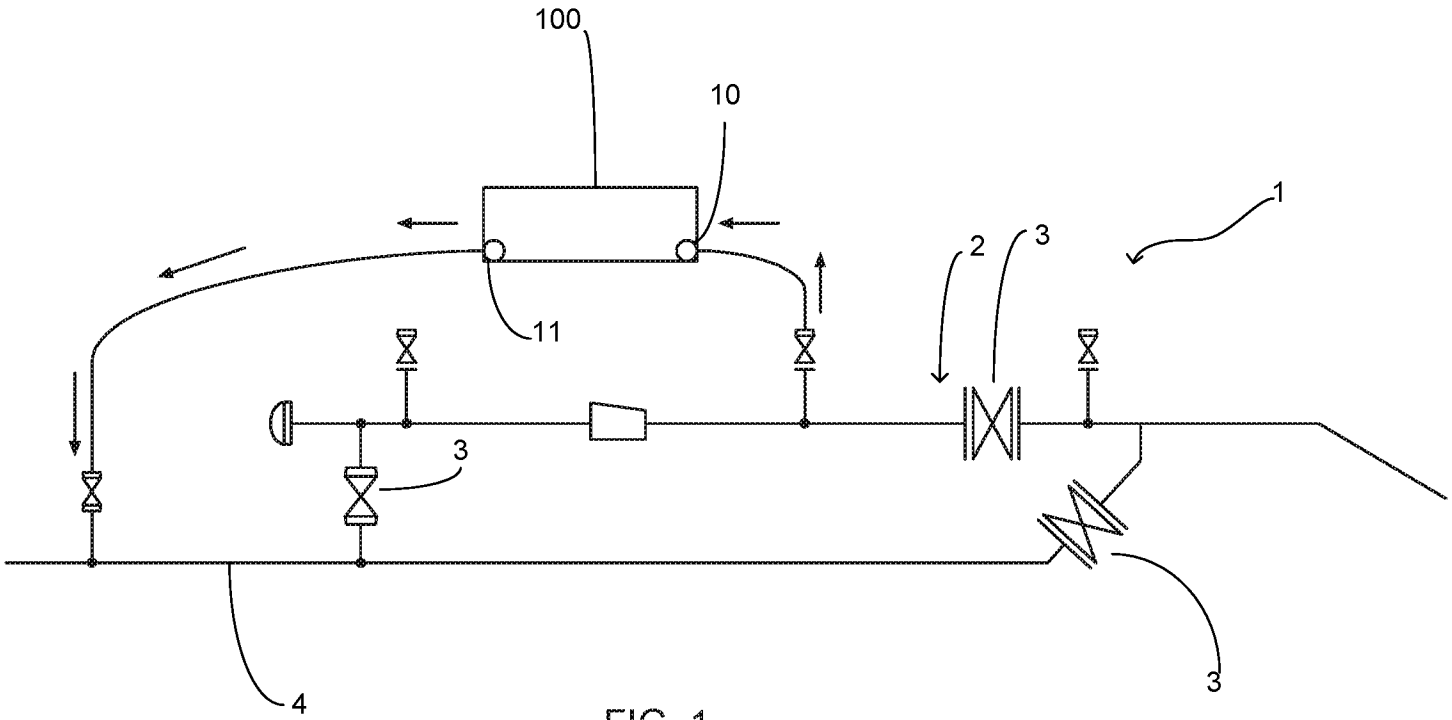
FIG. 1 is a diagrammatic view of a pipeline portion configuration illustrating the placement of the present invention.

Referring now to the drawings submitted herewith, wherein various elements depicted therein are not necessarily drawn to scale and wherein through the views and figures like elements are referenced with identical reference numerals, there is illustrated a fluid transfer and depressurization system 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to FIG. 1 herein, a pipeline schematic 1 is illustrated therein so as to demonstrate an exemplary installation of the fluid transfer and depressurization system 100. The fluid transfer and depressurization system 100 is fluidly coupled to a pipeline portion 2 that requires to have the contents therein removed. The pipeline portion 2 is a conventional pipeline portion such as but not limited to a pigging station. The pipeline portion 2 is configured to be isolated utilizing the appropriate valves 3. The fluid transfer and depressurization system 100 is coupled to the pipeline portion 2 at the gas inlet 10 of the fluid transfer and depressurization system 100 utilizing a suitable hose or similar element. The fluid transfer and depressurization system 100 is operably coupled to an adjacent pipeline portion 4 via the gas discharge port 11 utilizing suitable hosing or tubing. As the fluid transfer and depressurization system 100 commences operation the pressurized gas stored in pipeline portion 2 is transferred to the adjacent pipeline portion 4 that is also at a pressure that is greater than that of atmospheric pressure. During operation of the fluid transfer and depressurization system 100 the contents disposed within the pipeline portion 2 are completely evacuated and transferred to adjacent pipeline portion 4. At the termination of the operating cycle of the fluid transfer and depressurization system 100 the pipeline portion 2 has been substantially evacuated of its contents and the pressure therein is at or below atmospheric pressure. Ensuing completion of the evacuation of the contents disposed in the pipeline portion 2, the pipeline portion 2 can be accessed for maintenance or other purposes.

Figure 7:
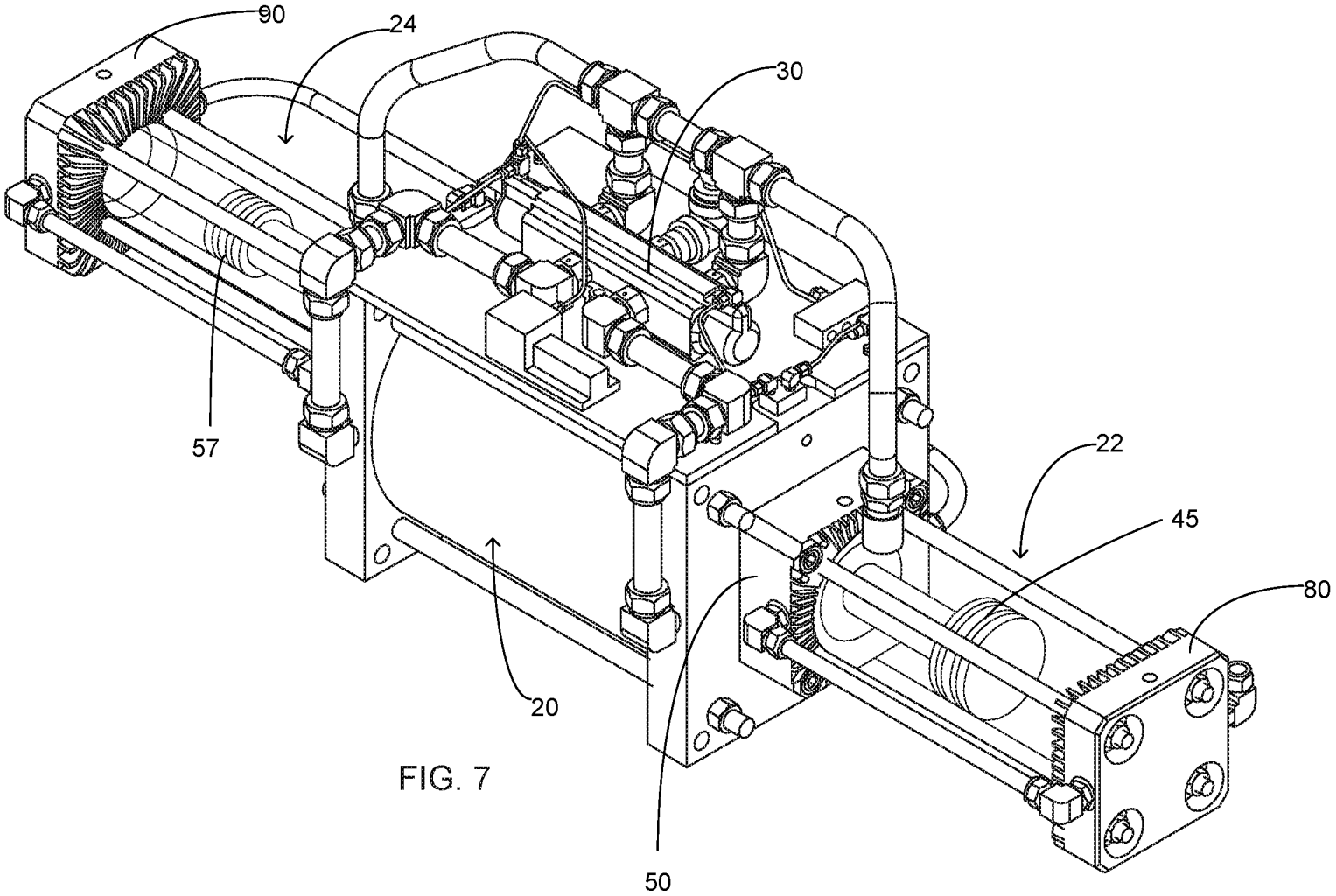
FIG. 7 is a perspective view of the present invention.

The fluid transfer and depressurization system 100 is disposed within a suitable durable housing (not illustrated herein) and as illustrated herein in FIG. 7 includes a drive chamber 20 having a first cylinder 22 operably coupled thereto and a second cylinder 24 operably coupled thereto on the opposing side thereof. The fluid transfer and depressurization system 100 in its preferred embodiment is powered utilizing compressed air which is introduced via the air inlet 26. Air inlet 26 is operably coupled to a conventional compressed air source such as but not limited to a compressor or air tank utilizing conventional elements. The air is directed via tubing 28 to the controller 30. Operably coupled to tubing 28 are conventional elements such as but not limited to a filter 21, regulator 23 and lubricator 25. The immediately aforementioned elements are well known in the art and provide required functionality when utilizing compressed air. The controller 30 is constructed similarly to an air-switching valve and functions to direct air into the interior volume 19 of the drive chamber 20. Controller 30 functions to alternate the flow of air into the drive chamber 20 so as to facilitate the reciprocal movement of the drive assembly 35. The controller 30 is operably coupled to the drive chamber 20 utilizing tubing 39. Tubing 39 is conventional metal tubing and is configured to direct air into the drive chamber so as to facilitate the reciprocal movement of the drive assembly 35.

Drive assembly 35 includes a drive member 38 and rod 40. Drive member 38 is manufactured from a suitable durable material as is movably secured within the interior volume 19 of the drive chamber 20. The drive member 38 is sealably engaged with the inner wall 27 utilizing suitable durable techniques so as to inhibit air from leaking across the drive member 38. Rod 40 includes first portion 41 and second portion 42. First portion 41 extends outward from the first side 48 of the drive member 38 and is perpendicular thereto. First portion 41 extends inward into first cylinder 22. Integrally formed on the end 44 of the first portion 41 is piston 45. Piston 45 is sealably engaged with the first cylinder 22 utilizing suitable durable techniques. As will be further discussed herein, reciprocal movement of the piston 45 will facilitate transfer of gas from the gas inlet 10 to the gas discharge port 11. The first cylinder 22 is constructed of suitable durable material and is manufactured to a desired length and diameter so as to accommodate a preferred amount of fluid therein.

Operably intermediate the first cylinder 22 and the drive chamber 20 is the first coupling block 50. First coupling block 50 is manufactured from a suitable durable material such as but not limited to metal. The first coupling block 50 provides a technique to sealably secure the first cylinder to the drive chamber 20 and additionally provide gas flow into the first cylinder 22. First coupling block 50 includes sealing members 51 configured to provide a sealable connection intermediate first portion 41 of rod 40. An upper passage 54 and a lower passage 56 are formed within the first coupling block 50 utilizing suitable techniques. The upper passage 54 is fluidly coupled to the gas inlet manifold 60 so as to facilitate introduction of gas into the first cylinder 20 therethrough during a movement of the piston 45 wherein the piston 45 is traveling away from the drive chamber 20. The lower passage 56 provides an operably coupling to the gas discharge manifold 65. During a movement of the piston 45 inwards towards the drive chamber 20 gas disposed intermediate the piston 45 and the drive chamber 20 is transferred to gas discharge manifold 65 via lower passage 56.

The fluid transfer and depressurization system 100 includes second cylinder 24 opposedly coupled to the drive chamber 20 relative to the first cylinder 22. The second cylinder 24 is constructed similarly to the first cylinder 22 and is configured to receive and discharge a fluid being transferred by the fluid transfer and depressurization system 100. The second portion 42 of the rod 40 extends into the second cylinder 24 and is sealably engaged therewith. Second portion 42 of the rod 40 has a piston 57 integrally formed on the end thereof distal to the drive member 38. Piston 57 is sealably coupled with second cylinder 24 utilizing suitable durable techniques. Piston 57 is reciprocally movable within the interior volume of second cylinder 24. As drive member 38 alternates direction of travel, piston 57 moves in conjunction therewith and as further discussed herein facilitates fluid transfer from the gas inlet 10 to the gas discharge port 11. Intermediate the drive chamber 20 and the second cylinder 24 is the second coupling block 70. The second coupling block 70 provides a sealable operable coupling of the drive chamber 20 and the second cylinder 24. The second coupling block 70 includes sealing elements 72 surroundably mounted to second portion 42 of the rod 40. Sealing elements 72 provide the necessary hermetic seal and it is contemplated within the scope of the present invention that the sealing elements 72 could be formed from various suitable materials such as but not limited to rubber. The second coupling block 70 further has formed therein an upper passage 75 and a lower passage 76. The upper passage 75 is operably coupled to gas inlet manifold 60 and is configured to facilitate flow of fluid therebetween. The lower passage 76 is operably coupled to the gas discharge manifold 65 and allows the flow of fluid therebetween during a piston 57 movement that is traversing towards the drive chamber 20.

Operably coupled to first cylinder 22 distal to the drive chamber 20 is first gas block 80. The first gas block 80 is hermetically coupled to the first cylinder 22 and is manufactured from a suitable durable material. The first gas block 80 is fluidly coupled to the first cylinder 22 and provides additional passages for transfer of fluid from the gas inlet manifold 60 to the gas discharge manifold 65. First gas block 80 includes first passage 81 and second passage 82 fluidly coupled to the gas inlet manifold 60 and gas discharge manifold 65 respectively. As is further discussed herein, dependent of the direction of movement of the piston 45 fluid is transferred into and/or out of the first cylinder 22 via the first passage 81 and/or second passage 82.

Operably coupled to second cylinder 24 distal to the drive chamber 20 is second gas block 90. The second gas block 90 is hermetically coupled to the second cylinder 24 and is manufactured from a suitable durable material. The second gas block 90 is fluidly coupled to the second cylinder 24 and provides additional passages for transfer of fluid from the gas inlet manifold 60 to the gas discharge manifold 65. Second gas block 90 includes first passage 91 and second passage 92 fluidly coupled to the gas inlet manifold 60 and gas discharge manifold 65 respectively. As is further discussed herein, dependent of the direction of movement of the piston 57 fluid is transferred into and/or out of the second cylinder 24 via the first passage 91 and/or second passage 92.

The reciprocal movement of the drive member 38 is provided by the compressed air and its distribution thereof by the controller 30. The controller 30 will alternate the flow of air through tubes 39 so as to facilitate the reciprocal movement of the drive member 38. By way of example but not limitation, an exemplary movement of the drive member 38 is as follows. The controller 30 will direct air into tube 139 so as to drive air into the drive chamber area 120. The compressed air is introduced at a sufficient pressure into the drive chamber area 120 so as to move the drive member 38 in the direction towards the second cylinder 24. As the drive member 38 traverses towards the second cylinder 24 and becomes proximate thereto, the drive member 38 will engage first switch 110. First switch 110 is operably coupled to controller 30 and upon engagement therewith, the controller 30 will terminate supply of air into tube 139 and alternate supply of compressed air into tube 137. Subsequent the air supply alteration, the drive member 38 will commence traversing through the drive chamber 20 in the alternate direction towards the first cylinder 22. The drive member 38 continues travel towards the first cylinder 22 until engagement of the second switch 111 which will return the airflow to the first step discussed above. The gas transfer from the first cylinder 22 and second cylinder 24 as a result of the drive member 38 movement will be further discussed herein.

Figure 3:
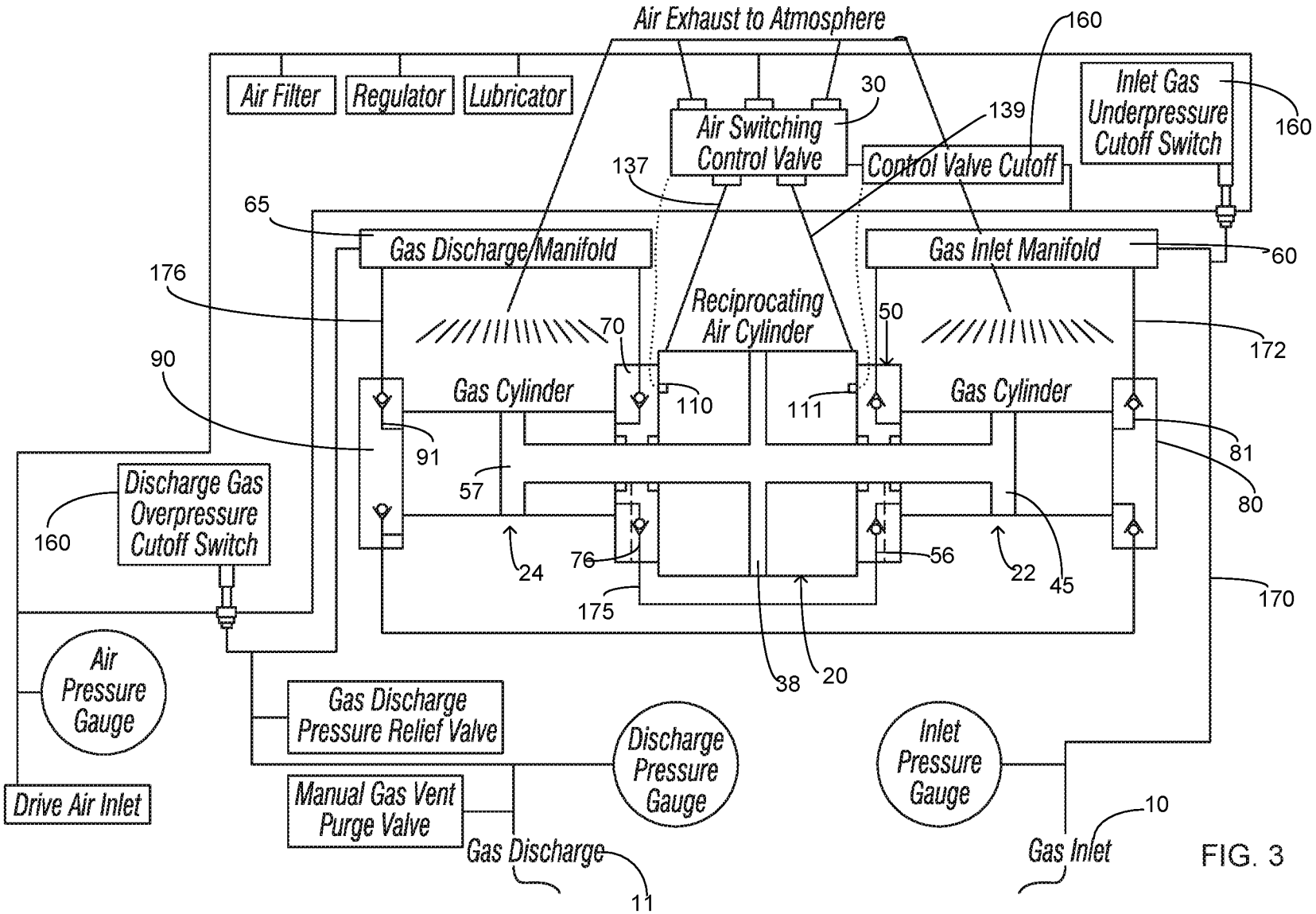
FIG. 3 is a diagrammatic view of an alternative configuration of the present invention.
Figure 4:
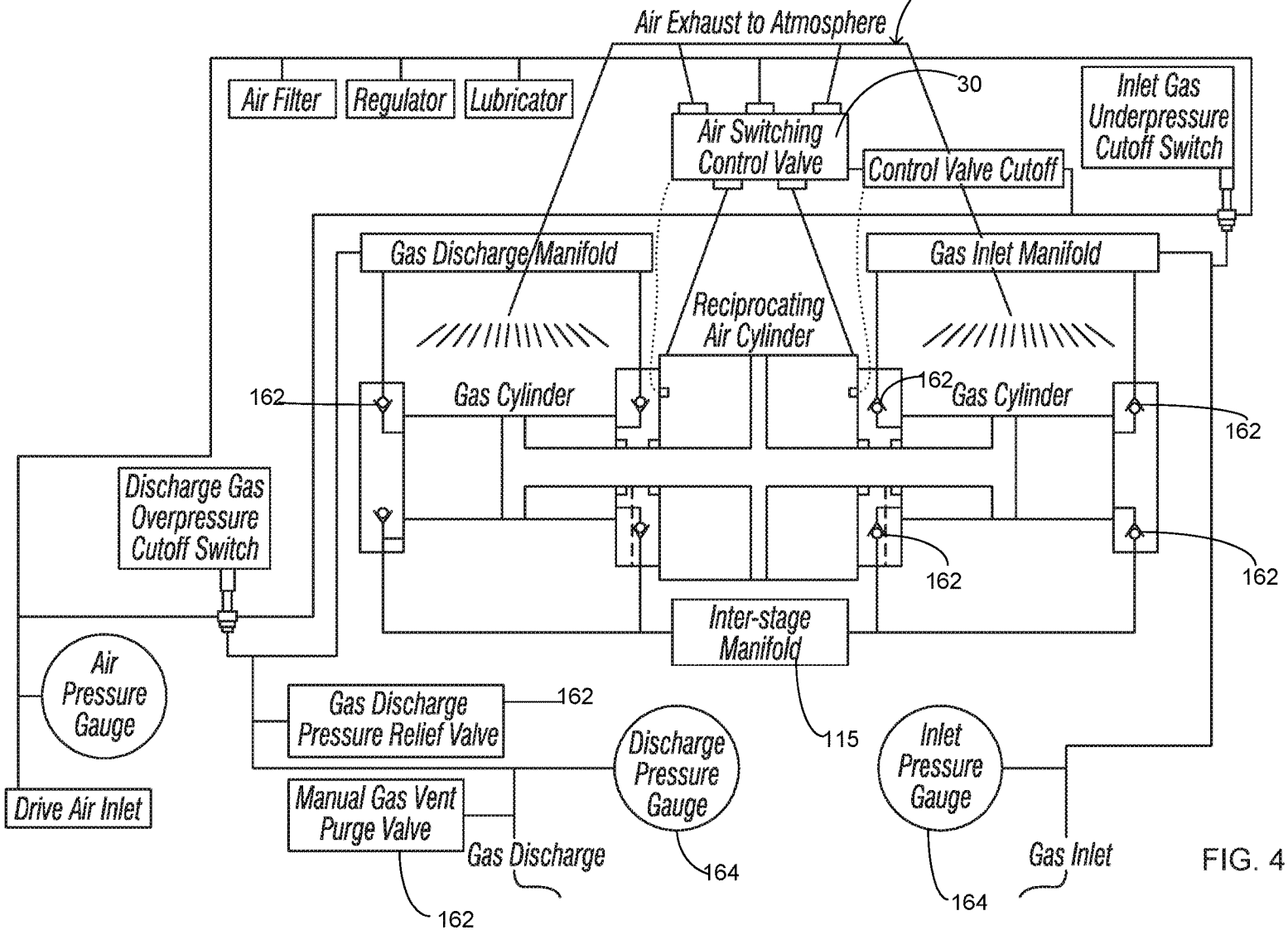
FIG. 4 is a diagrammatic view of an additional configuration of the present invention.
Figure 5:
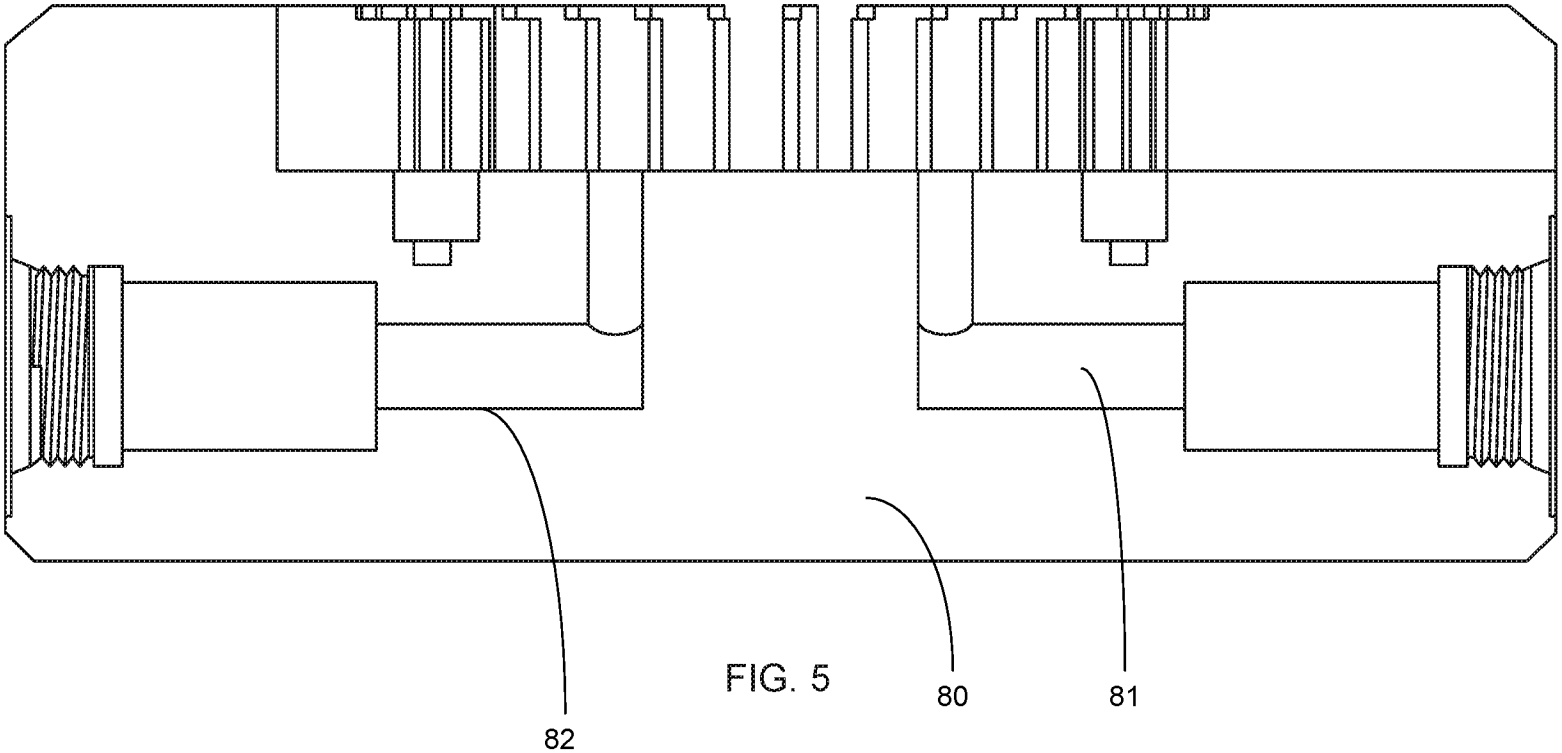
FIG. 5 is a diagrammatic view of an end view of a gas block of present invention.
Figure 6:
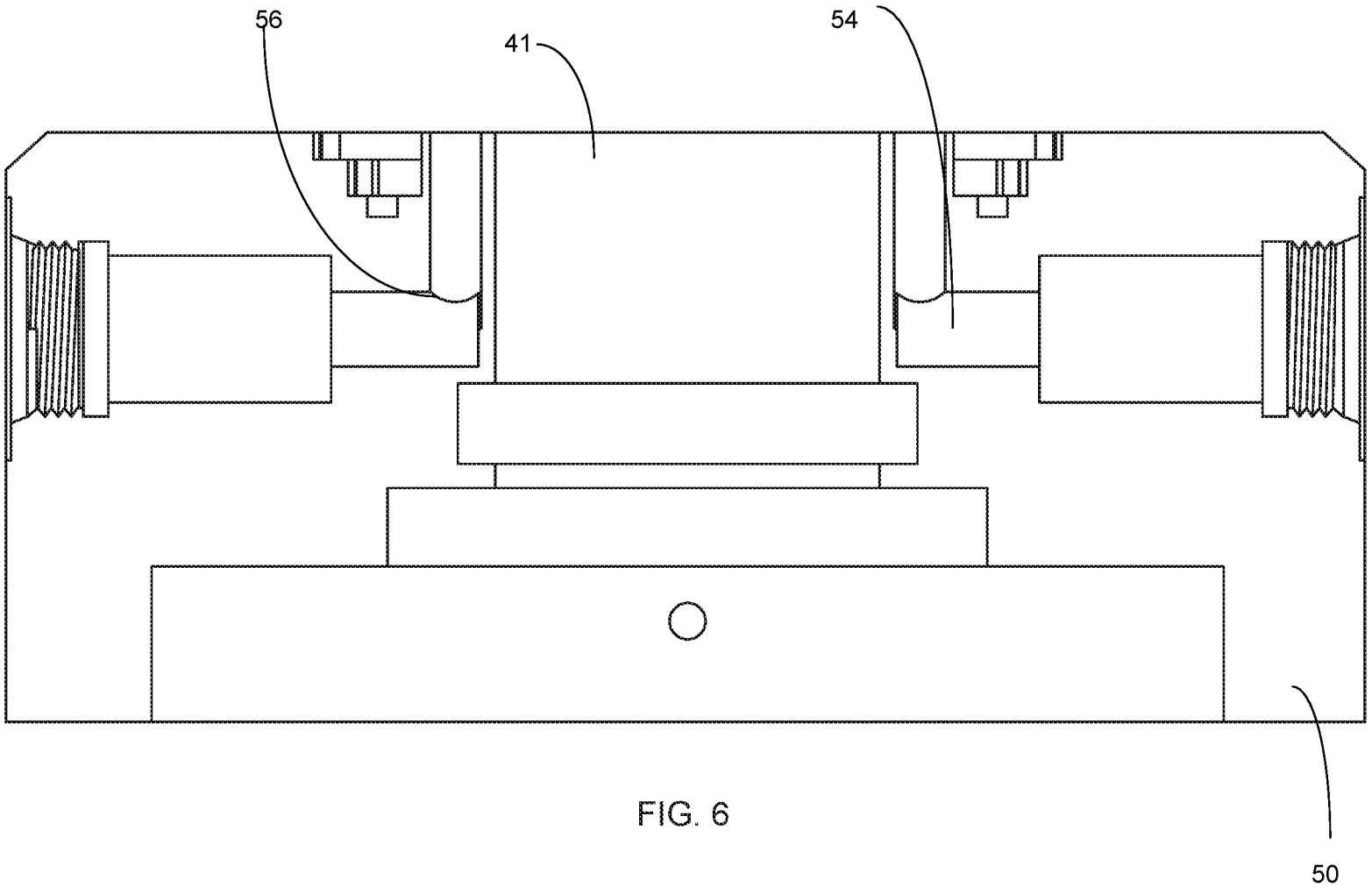
FIG. 6 is a diagrammatic view of a cylinder perspective view of the coupling block of the present invention.

The gas inlet 10 is operably coupled to the gas inlet manifold 60. The gas inlet manifold 60 is constructed of suitable durable material and has an interior volume that is configured to receive/stage a gas being introduced thereinto from the gas inlet 10. As is illustrated herein in FIG. 2 through FIG. 4, it is contemplated within the scope of the present invention that the fluid transfer and depressurization system 100 could have alternate configurations/quantities of the gas inlet manifold 60. The gas inlet manifold 60 functions to provide a sufficient volume of gas to first cylinder 22 and/or second cylinder 24 during operation of the fluid transfer and depressurization system 100. Exemplary configurations of the present invention include having a single gas inlet manifold 60 fluidly coupled to the first cylinder 22 and second cylinder 24. Alternatively, as illustrated herein in FIGS. 3 and 4 herein, a contemplated configuration of the fluid transfer and depressurization system 100 would utilize a gas inlet manifold 60 that is fluidly coupled to the first cylinder 22. Additionally, as shown in FIG. 4 herein, an inter-stage manifold 115 is further contemplated. The various configurations discussed and illustrated herein for the gas inlet manifold 60 do not serve as limitations but provide exemplary configurations which are a part of the contemplated present invention. It is contemplated within the scope of the present invention that at least one gas inlet manifold 60 is provided so as to receive and store gas from the gas inlet 10.

The gas discharge manifold 65 is operably coupled to the gas discharge port 11 and is manufactured from a suitable durable material. The gas discharge manifold 65 is constructed to have an interior volume being of sufficient size to accommodate gas from either the first cylinder 22 and/or the second cylinder 24 as the gas is discharged therefrom. The gas discharge manifold 65 provides a technique to direct the outflow of gas to the gas discharge port 11. As illustrated herein through FIG. 2 and FIG. 4 it is contemplated within the scope of the present invention that the fluid transfer and depressurization system 100 could have alternate configurations and/or quantities of gas discharge manifolds 65. In one contemplated configuration as illustrated herein in FIG. 2, the gas discharge manifold 65 is fluidly coupled to the first cylinder 22 and the second cylinder 24. An alternate configuration contemplated within the scope of the present invention as illustrated in FIG. 3 submitted as a part hereof wherein the gas discharge manifold 65 is operably coupled to the second cylinder 24. An additional configuration includes utilization of an inter-stage manifold 115 as illustrated herein in FIG. 4. It should be understood within the scope of the present invention that the fluid transfer and depressurization system 100 could deploy as few as one gas discharge manifold 65 or more than one.

Referring again to the controller 30, the controller 30 has operably coupled thereto tubing 120. Tubing 120 is manufactured from conventional material such as but not limited to metal tubing. As the drive assembly 35 is reciprocally moved by the compressed air as described herein, release of the compressed air is intrinsic to the operational cycle of the drive assembly 35. The controller 30 directs the release of air to atmosphere utilizing tubing 120. Tubing 120 is configured so as to have a portion thereof end adjacent the first cylinder 22 and another portion end proximate the second cylinder 24. The air discharged from the tubing 187 functions to provide cooling of the first cylinder 22 and second cylinder 24. It is contemplated within the scope of the present invention that the tubing 187 could be configured in alternate manners and further be configured to provide an atmospheric vent for the compressed air and not be directed so as to provide the cooling discussed herein.

Illustrated herein as being a part of the fluid transfer and depressurization system 100 are a plurality of conventional components that are known in the art of pressurized gas systems. By way of example but not by way of limitation, the fluid transfer and depressurization system 100 employs exemplary cutoff switches 160, exemplary valves 162 and exemplary gauges 164 that are deployed and utilized in a conventional manner so as to control flow, direct flow and measure flow as is known in the art. It is contemplated within the scope of the present invention that the fluid transfer and depressurization system 100 could employ various quantities of exemplary cutoff switches 160, exemplary valves 162 and exemplary gauges 164 as needed to provide the desired aforementioned functionality.

Now referring to FIG. 3 herein, a discussion of an exemplary flow path of gas within the fluid transfer and depressurization system 100 is as follows. Controller 30 is configured such that compressed air is being introduced into the drive chamber 20 via tube 139 and air disposed in the drive chamber 20 intermediate the drive member 38 and the second cylinder 24 is being expelled via tube 137. As compressed air flows through tube 139 the drive member 38 traverses towards the second cylinder 24. As the drive member 38 traverses towards the second cylinder 24 gas from the gas inlet 10 travels through tube 170 into gas inlet manifold 60. The gas flow continues through tube 172 into the interior volume of the first cylinder 22 in particular the portion intermediate the first gas block 80 and piston 45. Gas disposed on the opposing side of the piston 45 in the first cylinder 22 egresses therefrom as the piston 45 is traveling in conjunction with the drive member 38. Gas intermediate the piston 45 and the first coupling block 50 is directed through lower passage 56 into tubing 175. The gas flows from tubing 175 to the second passage 76 of the second coupling block 70 and is introduced into the second cylinder 24 wherein the gas will be disposed intermediate the piston 57 and the second coupling block 70. Simultaneously, gas disposed intermediate piston 57 and second gas block 90 propagates passage 91 outward towards the gas discharge manifold 65. The gas continues outward from the gas discharge manifold 65 via tube 176 where the gas exits the fluid transfer and depressurization system 100 via the gas discharge port 11. The immediately aforementioned flow path description for the fluid transfer and depressurization system 100 serves to demonstrate a flow path for a single movement of the drive member 38. During the reciprocal movement of the drive member 38 it should be understood by those skilled in the art that a similar but opposing flow path occurs. It is contemplated within the scope of the present invention that the flow path of the fluid transfer and depressurization system 100 will vary based upon the configurations illustrated herein and contemplated as a part of the present invention. Irrespective of the particular configuration, as the drive member 38 is reciprocally moved within the drive chamber 20 the introduction of gas into either the first cylinder 22 or the second cylinder 24 occurs and simultaneous expulsion of gas from the opposing cylinder occurs and is discharged outward from the fluid transfer and depressurization system 100 via the gas discharge port 11. The fluid transfer and depressurization system 100 is configured so as to operably couple to a first location having a pressurized gas disposed therein and transfer the gas to a second location wherein during operation the fluid transfer and depressurization system 100 depressurizes the first location without the loss of gas to the atmosphere. It is further contemplated within the scope of the present invention that the fluid transfer and depressurization system 100 could move a fluid at atmospheric pressure from a first location to a second location wherein the second location is also at atmospheric pressure.

While the fluid transfer and depressurization system 100 has been discussed herein for movement of a pressurized gas from a first location to a second location, it is contemplated within the scope of the present invention that the fluid transfer and depressurization system 100 could be utilized to move various types of fluids such as but not limited to liquids. Additionally, while the fluid transfer and depressurization system 100 has been illustrated and discussed herein as having a first cylinder 22 and a second cylinder 24 opposedly located with respect to the drive chamber 20, it is further contemplated within the scope of the present invention that more than two cylinders could be utilized. By way of example but not limitation, four or more cylinders increasing by paired numbers could be utilized in the fluid transfer and depressurization system 100 and achieve the desired functionality as described herein. While not suitable for all operational environments of the fluid transfer and depressurization system 100, it is further contemplated within the scope of the present invention that the operational technique of utilizing compressed air could be replaced with alternate suitable techniques such as but not limited to electric motors, wherein an electric motor would reciprocally move the drive assembly 35 as described herein. It should be further understood by those skilled in the art that the fluid transfer and depressurization system 100 while illustrated and discussed herein as being utilized in a standalone configuration could further be deployed in parallel or series configurations.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A fluid transfer system configured to transfer a fluid from a first location to a second location inhibiting exposure of the fluid to atmosphere wherein the fluid transfer system comprises:

a fluid inlet, said fluid inlet being operably coupled to the first location;

a fluid discharge port, said fluid discharge port being operably coupled to the second location;

a drive chamber, said drive chamber having an interior volume, said drive chamber having a first end and a second end;

a first switch in said drive chamber on or proximate said first end of said drive chamber;

a second switch in said drive chamber on or proximate said second end of said drive chamber;

a drive assembly disposed in said drive chamber, said drive assembly being movable within said interior volume of said drive chamber, said drive assembly having a first movement and a second movement, said first movement and said second movement of said drive assembly being reciprocal, said drive assembly having a drive member, said drive member sealably mounted within the interior volume of said drive chamber, said drive member having a first side and a second side, said drive member configured to reciprocally traverse within the interior volume of said drive chamber, said drive member to trigger said first switch during said first movement and trigger said second switch during said second movement;

a first cylinder, said first cylinder operably coupled to said drive chamber at said first end thereof, said first cylinder having a first end and a second end, said first cylinder having an interior volume, said first cylinder being operably coupled to said fluid inlet;

a second cylinder, said second cylinder being operably coupled to said drive chamber at said second end of said drive chamber, said second cylinder having a first end and a second end, said second cylinder having an interior volume, said second cylinder being operably coupled to said fluid discharge port;

a controller, said controller being operably coupled to said drive chamber, said controller configured to facilitate the first movement and the second movement of the drive assembly, wherein the fluid is transferred from the first location to the second location during execution of the first movement and second movement of the drive assembly;

a first coupling block, said first coupling block being mounted intermediate said first cylinder and said drive chamber; and a second coupling block, said second coupling block being mounted intermediate said second cylinder and said drive chamber, said second coupling block having an upper passage and a lower passage, said lower passage configured to facilitate flow of fluid therethrough from said first cylinder to the interior volume of said second cylinder.

2. The fluid transfer system as recited in claim 1, wherein said drive assembly further includes a drive rod, said drive rod having a first portion and a second portion, said first portion of said drive rod extending outward from said first side of said drive member, said first portion of said drive rod configured to operably penetrate into said first cylinder, said second portion of said drive rod extending outward from said second side of said drive member, said second portion of said drive rod configured to operably penetrate into said second cylinder.

3. The fluid transfer system as recited in claim 2, wherein said first coupling block is configured to have said first portion of the drive rod extend sealably therethrough, said first coupling block having an upper passage, said upper passage of said first coupling block fluidly coupled to said fluid inlet, said first coupling block having a lower passage, said lower passage of said first coupling block being fluidly coupled to said lower passage of said second coupling block.

4. The fluid transfer system as recited in claim 3, wherein said second coupling block is configured to have said second portion of said drive rod extend sealably therethrough.

5. The fluid transfer system as recited in claim 4, and further including a first gas block, said first gas block being mounted to said second end of said first cylinder distal to said drive chamber, said first gas block having a first passage and a second passage, said first passage and said second passage of said first gas block configured to allow fluid to flow therethrough, said first passage of said first gas block fluidly coupling said first cylinder and said fluid inlet.

6. The fluid transfer system as recited in claim 5, and further including a second gas block, said second gas block being mounted to said second cylinder at said second end thereof, said second gas block having a first passage and a second passage, said first passage and said second passage of said second gas block configured to have a fluid flow therethrough, said first passage of said second gas block being fluidly coupled to said fluid discharge port.

7. The fluid transfer system as recited in claim 6, wherein during the first movement and the second movement of said drive assembly, fluid from the first location is transferred into said first cylinder, into said second cylinder, and then to the second location.

8. A fluid transfer and depressurization system that is configured to transfer a gas from a first location to a second location wherein the pressure at the first location is at a pressure that is greater than that of atmospheric pressure wherein the fluid transfer and depressurization system comprises:

a fluid inlet, said fluid inlet being operably coupled to the first location, said fluid inlet having tubing coupled thereto, said tubing configured to direct gas into the fluid transfer and depressurization system;

a fluid discharge port, said fluid discharge port being operably coupled to the second location facilitating the deposit of gas thereinto;

a drive chamber, said drive chamber having an interior volume, said drive chamber having a first end and a second end, said drive chamber having disposed therein a drive assembly, said drive assembly being movable within said interior volume of said drive chamber, said drive assembly having a first movement and a second movement, said first movement and said second movement of said drive assembly being reciprocal, said drive assembly having a drive member, said drive member sealably mounted within the interior volume of said drive chamber, said drive member having a first side and a second side, said drive assembly having a drive rod, said drive rod having a first portion and a second portion, said first portion of said drive rod extending outward from said first side of said drive member, said first portion of said drive rod having a piston integrally formed thereon distal to said drive member, said second portion of said drive rod extending outward from said second side of said drive rod, said second portion of said drive rod having a piston formed thereon distal to said drive member, said drive member configured to reciprocally traverse within the interior volume of said drive chamber;

at least one first cylinder, said at least one first cylinder operably coupled to said drive chamber at said first end thereof, said at least one first cylinder having a first end and a second end, said at least one first cylinder having an interior volume, said at least one first cylinder having the first portion of said drive rod extending thereinto;

at least one second cylinder, said at least one second cylinder being operably coupled to said drive chamber at said second end of said drive chamber, said at least one second cylinder having a first end and a second end, said at least one second cylinder having an interior volume, said at least one second cylinder being operably coupled to said fluid discharge port;

a controller, said controller being operably coupled to a compressed air source, said controller having a first exit tube and a second exit tube, said first exit tube operably coupled intermediate said controller and said drive chamber proximate said first end of said drive chamber, said second exit tube being operably coupled intermediate said controller and said second end of said drive chamber, said first exit tube and said second exit tube configured to provide alternating sources of compressed air into the interior volume of said drive chamber so as to reciprocally move said drive member;

a first coupling block, said first coupling block being mounted intermediate said at least one first cylinder and said drive chamber, said first coupling block having the first portion of said drive rod extending therethrough, said first coupling block having sealing members surroundably mounted to said first portion of said drive rod, said first coupling block having an upper passage, said upper passage configured to facilitate flow of gas therethrough from said fluid inlet to the interior volume of said at least one first cylinder; and a second coupling block, said second coupling block being mounted intermediate said at least one second cylinder and said drive chamber, said second coupling block having the second portion of said drive rod extending therethrough, said second coupling block having sealing members surroundably mounted to said second portion of said drive rod, said second coupling block having an upper passage and a lower passage, said lower passage configured to facilitate flow of gas therethrough from said at least one first cylinder to the interior volume of said at least one second cylinder, wherein gas is transferred from the first location to the second location during execution of the first movement and second movement of the drive assembly and wherein during the transfer of gas the pressure at the first location is reduced to a pressure that is at or less than atmospheric pressure.

9. The fluid transfer and depressurization system as recited in claim 8, and further including a first gas block, said first gas block being mounted to said second end of said at least one first cylinder distal to said drive chamber, said first gas block having a first passage and a second passage, said first passage and said second passage of said first gas block configured to allow gas to flow therethrough, said first passage of said first gas block fluidly coupling said first cylinder and said fluid inlet.

10. The fluid transfer and depressurization system as recited in claim 9, and further including a second gas block, said second gas block being mounted to said second cylinder at said second end thereof, said second gas block having a first passage and a second passage, said first passage and said second passage of said second gas block configured to have gas flow therethrough, said second passage of said second gas block being fluidly coupled to said fluid discharge port, said first passage of said second gas block being operably coupled to said second passage of said first gas block.

11. The fluid transfer and depressurization system as recited in claim 10, wherein during said first movement of said drive assembly, gas is introduced from said fluid inlet into said first cylinder and is disposed intermediate said piston at said first end of said first portion of said drive rod and said first gas block.

12. The fluid transfer and depressurization system as recited in claim 11, wherein during said first movement of said drive assembly, gas intermediate said piston formed at said end of said first portion of said drive rod and said drive chamber is transferred through said lower passage of said first coupling block into said second cylinder wherein the gas is intermediate said drive chamber and the piston formed on the second end of said second portion of said drive rod.

13. The fluid transfer and depressurization system as recited in claim 12, wherein during the first movement, gas disposed in the at least one second cylinder intermediate the piston formed on the second portion of the drive rod and the second gas block egresses through said second passage of said second gas block and is transferred to said fluid discharge port.

14. The fluid transfer and depressurization system as recited in claim 13, and further including a gas inlet manifold and a gas discharge manifold, said gas inlet manifold being operably intermediate said fluid inlet and said at least one first cylinder, said gas discharge manifold being operably intermediate said at least one second cylinder and said fluid discharge port.

15. A fluid transfer system comprising:

a drive chamber having a first end, a second end, and an interior volume;

a drive assembly at least partially disposed in the drive chamber, the drive assembly being movable within the interior volume of the drive chamber, the drive assembly having a first movement and a second movement, the first movement and the second movement of the drive assembly being reciprocal, the drive assembly having a drive member sealably mounted within the interior volume of the drive chamber, the drive member configured to reciprocally traverse within the interior volume of the drive chamber;

a first cylinder extending from the first end of the drive chamber, the first cylinder having a first end, a second end, and an interior volume;

a first coupling block mounted between the first cylinder and the drive chamber, the first coupling block having an upper passage with a check valve configured to facilitate flow of fluid from a fluid inlet to the interior volume of the first cylinder;

a second cylinder extending from the second end of the drive chamber, the second cylinder having a first end, a second end, and an interior volume, the second cylinder fluidly coupled to a fluid discharge port;

a second coupling block mounted between the second cylinder and the drive chamber, the second coupling block having an upper passage and a lower passage, the lower passage of the second coupling block configured to facilitate flow of fluid from the first cylinder to the interior volume of the second cylinder; and a controller operably coupled to the drive chamber, the controller configured to facilitate the first movement and the second movement of the drive assembly, such that fluid is transferred from the fluid inlet to the fluid discharge port during execution of the first movement and second movement of the drive assembly.

16. The fluid transfer system of claim 15, wherein the check valve is a first check valve, and wherein the first coupling block has a lower passage with a second check valve configured to facilitate flow of fluid from the interior volume of the first cylinder to the interior volume of the second cylinder.

17. The fluid transfer system of claim 16, wherein the upper passage of the first coupling block extends to a first end of the first coupling block and the lower passage of the first coupling block extends to a second end of the first coupling block opposite the first end of the first coupling block.

18. The fluid transfer system of claim 15, further including a gas block coupled to the second end of the first cylinder.

19. The fluid transfer system of claim 18, wherein the check valve is a first check valve, the gas block having a first passage and a second check valve to facilitate flow of fluid from the fluid inlet to the interior volume of the first cylinder.

20. The fluid transfer system of claim 15, wherein the check valve is a first check valve, further including a gas block coupled to the second end of the second cylinder, the gas block having a first passage and a second check valve to facilitate flow of fluid from the interior volume of the second cylinder to the fluid discharge port.

* * * * *